US008913366B1

(12) United States Patent
Mezinis

(10) Patent No.: US 8,913,366 B1
(45) Date of Patent: Dec. 16, 2014

(54) VIRTUAL PHOTON POWER CONVERTER

(76) Inventor: Steven Mezinis, Garberville, CA (US)

( * ) Notice: Subject to any disclaimer, the term of this patent is extended or adjusted under 35 U.S.C. 154(b) by 945 days.

(21) Appl. No.: 13/049,289

(22) Filed: Mar. 16, 2011

(51) Int. Cl.
*H01T 23/00* (2006.01)

(52) U.S. Cl.
USPC ..... 361/230

(58) Field of Classification Search
CPC ..... H01T 23/00; G03G 21/0047
USPC ..... 361/230, 233
See application file for complete search history.

(56) References Cited

U.S. PATENT DOCUMENTS

2008/0198638 A1* 8/2008 Reinberger et al. ..... 363/74

* cited by examiner

*Primary Examiner* — Rexford Barnie
*Assistant Examiner* — Christopher Clark
(74) *Attorney, Agent, or Firm* — Michael I. Kroll

(57) ABSTRACT

A Virtual Photon Energy Amplification circuit for harnessing force or electrical energy from virtual photons existing in a quantum state by means of a discrete electric field circuit and a discrete magnetic field circuit having a capacitor transformer circuitry arrangement therein.

11 Claims, 10 Drawing Sheets

VIRTUAL PHOTON POWER CONVERTER

BACKGROUND OF THE INVENTION

1. Field of the Invention

The present invention relates generally to power amplification and, more specifically, to a device for harnessing force or electrical energy from virtual photons existing in a quantum state by means of a capacitor transformer circuitry arrangement.

Physics, in the field of quantum electrodynamics, hypothesizes the existence of virtual photons that are hypothetical photons with an infinite amount of potential energy. Virtual photons are used to explain the amount of physical force that can occur for a relatively small amount of electrical work with Coulomb's Law. The present invention attempts to convert the infinite power potential of a virtual photon into an actual electromagnetic power drive circuit-electrical energy, thereby amplifying electrical power through the use of a VPR (Virtual Photon Reference).

For any single phase power transformer attached to the grid the primary winding has an electro-magnetic footprint. Part of this footprint is that the primary is in an electric field. Out of this electric field across the primary there is an electron flow through the primary winding creating a magnetic field. Energy from the grid that creates these electric and magnetic fields is translated through the fields by the secondary winding and then to the house or whatever. The secondary gets its energy from these fields.

Both the electric and magnetic fields fluctuate with the frequency of the grid. The electric field component stays the same according to frequency and for the most part is constant. However, the magnetic field—electron flow—varies with power draw and is what translates the energy transfer. The current flow—magnetic field—in the primary is directly proportional to the energy—VA—being extracted from the transformer. And, for any single phase power transformer the voltage field and the electron source/magnetic field come from the same energy source.

With the Virtual Photon Power Converter (VPPC) there are two energy sources. The electric field energy source suspends the primary winding in a closed circuit electric field. With the electric field circuit, being a capacitive circuit, there is little to no current going through the primary as it is polarized and suspended in the electric field.

The current energy source feeds into this electric field suspended coil through a capacitor and provides the magnetic field component for the primary. When the electric field and current flow mix in said capacitor, the primary is energized by an electron flow coming out of one high voltage (HV) potential across the transformer, through the transformer, towards and into the other HV potential on the other side of the transformer. This provides the magnetic component of the primary winding's electro-magnetic footprint.

The secondary is energized by both of these field components mixing in the primary. From these fields, the secondary draws its energy or power. So, essentially what this device does is it would give a line transformer primary the same electro-magnetic field footprint and therefore VA capabilities of being on the grid; when it's not on the grid.

Since the HV circuit is a coil capacitor circuit, its power draw would be directly related to the capacitance and have a relatively low VA. In addition, normally the voltage on a capacitor is 90 degrees out of phase with the current in the coil across it. This necessitates a phase control device that keeps the voltage on the capacitors and therefore on the primary in phase with the current in current dive coil secondary.

The major VA consumption with this device would be the current source generating the magnetic fields in the electric field suspended primary winding. In addition this power consumption would be inversely proportional to the electric field potential—voltage—across the coil. For any transformer and a given power draw, the higher the voltage field across the primary, the less the current in the magnetic field circuit.

In summary, this device would give a single phase line transformer the electro-magnetic field footprint and VA capabilities of when it's attached to the grid with a VA input that is a fraction of its VA output. Energy is pulled out of the virtual photon quantum state to do this.

2. Description of the Prior Art

There are other power extraction systems. Typical of these is U.S. Pat. No. 4,720,642 issued to Marks on Jan. 19, 1988.

Another patent was issued to Scholl on Apr. 9, 2002 as U.S. Pat. No. 6,368,477. Yet another U.S. Pat. No. 6,477,028 was issued to Pinto on Nov. 5, 2002 and still yet another was issued on Nov. 12, 2002 to Vaz as U.S. Pat. No. 6,479,743.

Another patent was issued to Pinto on Dec. 16, 2003 as U.S. Pat. No. 6,665,167. Yet another U.S. Pat. No. 7,365,534 was issued to Tralshawala et al. on Apr. 29, 2008. Another was issued to Haisch et al. on May 27, 2008 as U.S. Pat. No. 7,379,286 and still yet another was issued on Aug. 6, 2009 to Eisenring as U.S. Patent Application No. 2009/0195961

Another patent application was published to Strevens on Mar. 10, 2007 as British Patent Application No. GB2436642. Yet another Russian Patent No. RU2357313 was published to Ajsenring on May 27, 2009.

U.S. Pat. No. 4,720,642

Inventor: Alvin M. Marks

Issued: Jan. 19, 1988

A Femto Diode responsive to light frequencies is described. Quantum principles are utilized. The Femto Diode comprises a submicron metal cylinder with an asymmetric metal-insulator-metal tunnel junction at one end and a reflecting potential step at the other end. A light photon having a quanta of energy is absorbed by an electron in the cylinder producing an energetic electron. The cylinder acts as a potential well for the energetic electron, which travels back and forth in its own conduction band without loss of energy until it passes through the junction. The kinetic energy of the energetic electron is converted to electric energy at a greater voltage on the other side of the junction. The energy conversion is reversible. The Femto Diode may be used in light to electric power conversion, a laser which converts electric power to light power, 2D and 3D displays, high speed computers, communications and other devices.

U.S. Pat. No. 6,368,477

Inventor: Richard A. Scholl

Issued: Apr. 9, 2002

A thin film plasma processing system which includes multiple power environments and circuitry is described so as to encompass a variety of configurations. The environments may establish an energy quantum which may be interactively adjusted such as for conditioning or processing when new targets or materials are inserted. The energy quantum can be increased from the traditionally low energy storage of a switch-mode power supply to a higher energy to allow more intense arc occurrences and, thus, the more rapid conditioning of a target. Switching between environments can be achieved manually or automatically through timing or through arc or plasma electrical characteristics sensing. Energy quantum may be adjusted through the inclusion of energy storage elements, hardwired elements, or through software configurations such as are possible with the utilization of a programmable processor. Applications for DC switch-mode thin film processing systems are specifically shown.

U.S. Pat. No. 6,477,028

Inventor: Fabrizio Pinto

Issued: Nov. 5, 2002

In some embodiments, the illustrative method defines an engine cycle comprising several state changes that allow for a net gain of energy from an underlying source force field. The potential for a net energy gain via the method results from the discovery that a Casimir force system can be rendered non-conservative. This is done by appropriately altering one or more of a variety of physical factors that affect the Casimir force, or by altering any of a variety of environmental factors that affect such physical factors. In various embodiments, the extracted energy is stored, used to power energy-consuming devices or used to actuate a micromechanical device. In one embodiment, the method is implemented using an energy extraction apparatus that comprises two spaced Casimir force-generating boundaries that are operatively coupled to an energy transformation system. The energy transformation system includes a first device that is operable to alter at least one physical factor of the system. The energy transformation system also includes a second device that is operable to change the distance between the two Casimir force-generating boundaries, and further operable to maintain the distance between the boundaries while the first device alters the physical factor.

U.S. Pat. No. 6,479,743

Inventor: Guy Andrew Vaz

Issued: Nov. 12, 2002

A photon power cell has at least one photo-electric cell (10), one or more layers of filter glass (15) and a radioactive-energized fluorescent material (20) which produces photons that are converted into electrical energy by the photo-electric cell (10). The photo-electric cell (10) may be a standard solar cell silicon wafer (14) with coatings (12) of phosphorus applied to the surface of the wafer (10). The layer of filter glass (15) contains lead, gold and/or graphite to protect the PN junction of the solar cell (10) from unwanted radioactive particles from the radioactive-energized fluorescent material (20), while being transparent to photons within a required frequency spectrum to produce a photo-electric effect. A plurality of solar cells (10) may be arranged in a stack interposed between layers or coatings of the radioactive-energized fluorescent material (20) to provide power cells which can power electric devices such as from mobile telephones to electric vehicles for several years.

U.S. Pat. No. 6,665,167

Inventor: Fabrizio Pinto

Issued: Dec. 16, 2003

In some embodiments, the illustrative method defines an engine cycle comprising several state changes that allow for a net gain of energy from an underlying source force field. The potential for a net energy gain via the method results from the discovery that a Casimir force system can be rendered non-conservative. This is done by appropriately altering one or more of a variety of physical factors that affect the Casimir force, or by altering any of a variety of environmental factors that affect such physical factors. In various embodiments, the extracted energy is stored, used to power energy-consuming devices or used to actuate a micromechanical device. In one embodiment, the method is implemented using an energy extraction apparatus that comprises two spaced Casimir force-generating boundaries that are operatively coupled to an energy transformation system. The energy transformation system includes a first device that is operable to alter at least one physical factor of the system. The energy transformation system also includes a second device that is operable to change the distance between the two Casimir force-generating boundaries, and further operable to maintain the distance between the boundaries while the first device alters the physical factor.

U.S. Pat. No. 7,365,534

Inventor: Nilesh Tralshawala et al

Issued: Apr. 29, 2008

An instrument for measuring sub-pico Tesla magnetic fields using a superconducting quantum interference device (SQUID) inductively coupled to an unshielded gradiometer includes a filter for filtering magnetically- and electrically coupled radio frequency interference (RFI) away from the SQUID. This RFI is principally coupled to the SQUID via the unshielded gradiometer. The filter circuit includes a resistor-capacitor (RC) combination interconnected to first and second terminals so that it is parallel to both an input coil of the SQUID and the gradiometer. In addition, a shielding enclosure is used to electromagnetically shield the filter circuit from the SQUID, and a method is employed to increase the impedance between the input coil and the SQUID without diminishing the overall sensitivity of the instrument.

U.S. Pat. No. 7,379,286

Inventor: Bernard Haisch et al

Issued: May 27, 2008

A system is disclosed for converting energy from the electromagnetic quantum vacuum available at any point in the universe to usable energy in the form of heat, electricity, mechanical energy or other forms of power. By suppressing electromagnetic quantum vacuum energy at appropriate frequencies a change may be effected in the electron energy levels which will result in the emission or release of energy. Mode suppression of electromagnetic quantum vacuum radiation is known to take place in Casimir cavities. A Casimir cavity refers to any region in which electromagnetic modes are suppressed or restricted. When atoms enter into suitable micro Casimir cavities a decrease in the orbital energies of electrons in atoms will thus occur. Such energy will be captured in the claimed devices. Upon emergence form such micro Casimir cavities the atoms will be re-energized by the ambient electromagnetic quantum vacuum. In this way energy is extracted locally and replenished globally from and by the electromagnetic quantum vacuum. This process may be repeated an unlimited number of times. This process is also consistent with the conservation of energy in that all usable energy does come at the expense of the energy content of the electromagnetic quantum vacuum. Similar effects may be produced by acting upon molecular bonds. Devices are described in which gas is recycled through a multiplicity of Casimir cavities. The disclosed devices are scalable in size and energy output for applications ranging from replacements for small batteries to power plant sized generators of electricity.

U.S. Patent Application Number 2009/0195961

Inventor: Rolf Eisenring

Issued: Aug. 6, 2009

Quantum Batteries (super capacitors) which by a new quantum effect "virtual photon resonance" can store electrical energy as a pure electrical battery in ranges up to 15 MJ/kg and more. The battery is basically a capacitor composed of insulating matrix material with either dispersed nanocrystal particles of Rutile TiO2 or alternating layers of Rutile crystal TiO2 deposited by Vapor Deposition Process. After reaching the resonance conditions (electrostatic field has suitable 1) strength and 2) energy content) the capacitor becomes a constant voltage battery and takes up additional energy by Dirac current pulses at very fast rates. Thereby the Rutile crystal (semiconductor) changes its state from an insulator to becoming conductive. The battery can be built flat or wound. Voltage from a few to kVolts and top capacities are only limited to mechanical constraints. Due to the nearly zero source resistance the battery loads and discharges at constant voltage and at extremely high rates. Measurements on a first practical Quantum Battery sample shows qualitatively its principal function.

U.K. Patent Application Publication No GB2436642

Inventor: Christopher Strevens

Issued: Mar. 10, 2007

A quantum mechanics approach to transformer design is indicated. The electrostatic and photon interactions between windings provide the principles on which a transformer can be designed. A transformer arrangement is disclosed where the space between windings is filled with high permeability material. The high permeability material may be a mixture of resin and iron particles or a low loss ferrite. A cheaper, lighter, low power loss transformer not using a heavy iron laminated magnetic core may be developed.

Russian Patent Number RU2357313

Inventor: Rol F Ajsenring

Issued: May 27, 2009

FIELD: physics. ^ SUBSTANCE: present invention relates to quantum accumulators and to methods of making them. According to the invention the method and the accumulator can be realised using materials, consisting of bipolar chips in form of grains or layers with nanoscale thickness, laid in electrically insulating matrix materials or intermediate layers, deposited on combined films or firm flat substrates, made in form of roll-type or plate capacitors, which can accumulate over 15 MJ/kg electrical energy without loss, based on the virtual photon resonance phenomenon. A EFFECT: design of accumulators with high specific characteristics.

While these power amplification circuits may be suitable for the purposes for which they were designed, they would not be as suitable for the purposes of the present invention, as hereinafter described.

SUMMARY OF THE PRESENT INVENTION

Assuming electric fields can manifest a virtual photon reference (VPR) and assuming electric fields within capacitors have a VPR, then within the circuit of the present invention having a pair of high voltage capacitors connected in series there would be VPR within each capacitor, (b) and (c). The circuit across the two capacitors is another capacitor VPR(a) and this is the electric field that energizes the entire mixing capacitor plate/winding/plate/winding assembly. The electric field induced on the mixing capacitor plate/winding/plate/winding assembly electrically polarizes that assembly thus creating a fourth VPR(d). In summary a VPR is suspended inside another VPR with two VPRs connecting the two. This event occurs when any two capacitors are in series and in close proximity. In this circuit, within VPR(d), is an electrical closed circuit magnetic field device—plate/winding/plate/winding assembly—suspended between the electric fields. This device has one end of a pair of transformer windings going through one VPR while the other ends of the pair are connected through another VPR—(b) and (c)—and this magnetic field assembly is contained in VPR(d).

The goal behind this is to put electrical energy into a VPR system, tap into the infinite potential energy of a VPR and bring some of this infinite potential energy into actuality as it comes out of the VPR system as electrical energy—a power amplifier. It does this by feeding the input power into a closed high voltage capacitance system.

The device of the present invention has two separate power supply circuits; one provides the current (magnetic fields), while the other provides the voltage (electric fields). One power supply is a phase adjustable slave to the other power supply.

The two power supplies are mixed in a capacitor and transformer array through fields. Assuming AC is put in, one power supply provides the current (the magnetic field driver) while the other circuit provides the voltage (the electric field driver). It does this mixing by using a plate of a high voltage capacitor of one circuit as a conductor for the other separate current circuit. Since a voltage across a capacitor is 90 degrees out of phase with the current of a transformer in parallel with it, the phase between these two separate AC power supplies is shown as adjustable for optimum effectiveness with a phase control.

The power amplification circuit incorporates two circuits mixing in a transformer and a special capacitor circuit, one a current circuit—magnetic field related—while the other is a voltage circuit—electric field related. The (high) voltage is induced into the coil through electric fields in the capacitors (without a direct connection) and this help keeps the circuits' currents of the two power supplies electrically isolated.

In terms of operation, assuming one plate of the mixing-capacitor mixing-capacitor-induction plate becomes positive then the mixing-capacitor-voltage/current-mixing plate becomes negative. This is accompanied by a corresponding current flow from current-drive transformer. The electrons pushed by the current circuit into the coil—leaving the capacitor—are leaving a high voltage negative potential going towards its opposite charge (positive). The secondary of the transformer sees a high voltage across it that is accompanied with a corresponding current flow.

The result is the electric and magnetic fields induced in the secondary have an increased VA potential. This secondary of the mixing transformer feeds to a converter transformer, which conventionally feeds the load according to the VA required.

There would be a direct relationship between voltage applied to the mixing capacitors and power output. Conversely, an inverse relationship exists between voltage applied to the mixing capacitor and the current draw of the magnetic-drive circuit.

A primary object of the present invention is to provide a power amplification circuit utilizing quantum principals in order to harness and extract additional power from a quantum state.

Another object of the present invention is to provide a power amplification circuit utilizing capacitors and transformers in order to harness power from virtual photons in a quantum electric field.

Yet another object of the present invention is to provide a power amplification circuit utilizing a phased electric field and magnetic field in order to produce a condition useful in producing and harnessing virtual photons.

Still yet another object of the present invention is to provide power a power amplification circuit utilizing a pair of power sources modulated to create a phased electro-magnetic field for charging of a plurality of capacitors and transformers.

Additional objects of the present invention will appear as the description proceeds.

The present invention overcomes the shortcomings of the prior art by providing a means for utilizing a pair of phased power sources in order to produce both a phased magnetic and phased electric field utilized to produce a condition whereby access and harnessing of virtual photons is made possible by means of a capacitor, transformer arrangement capable of accessing and storing a charge from a quantum state.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
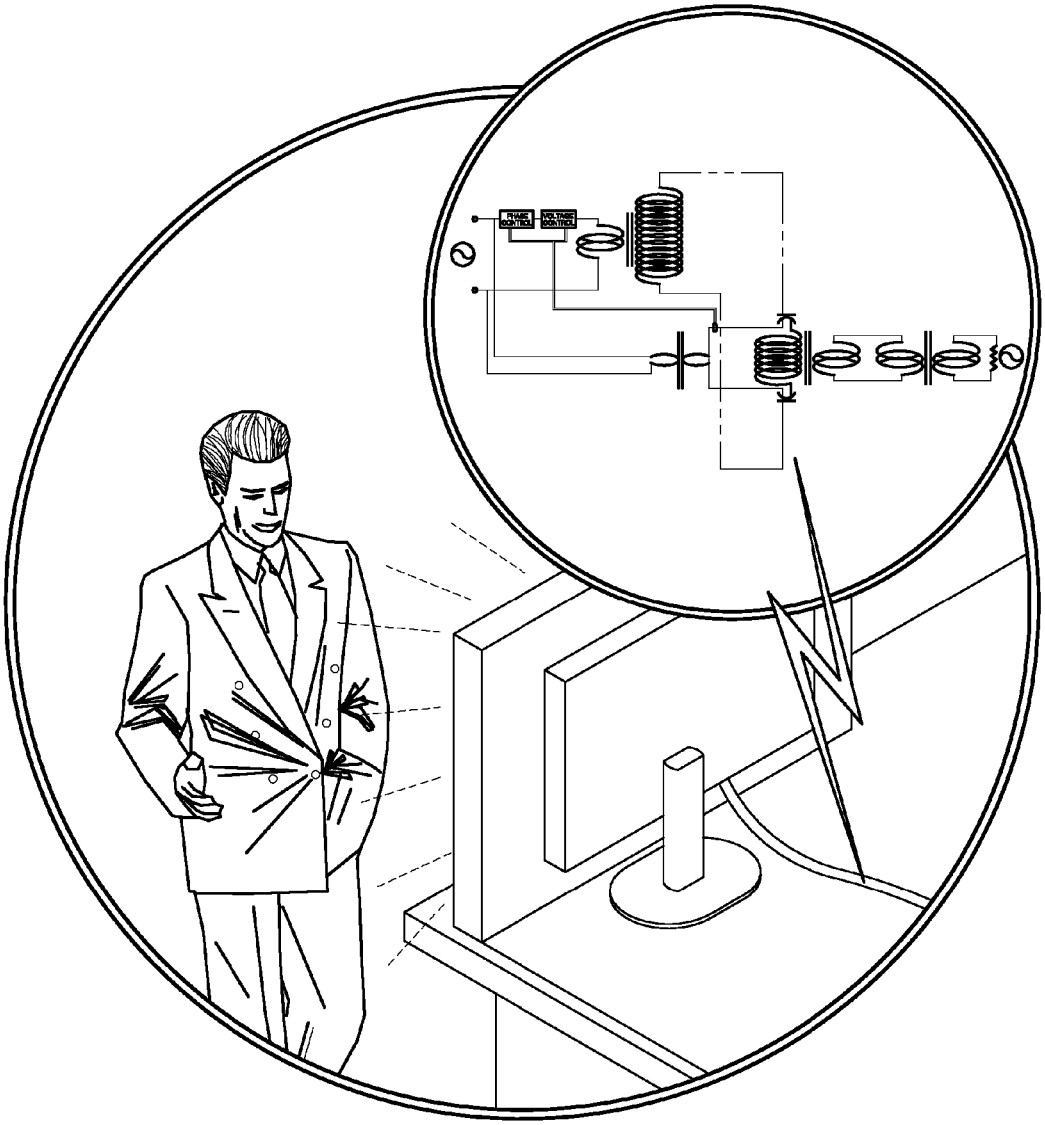
FIG. 1 is an illustrative view of a potential use of the power amplification circuit of the present invention.

Turning now descriptively to the drawing figures, in which similar reference characters denote similar elements throughout the several views, the figures illustrate the Virtual Photon Power Converter of the present invention. With regard to the reference numerals used, the following numbering is used throughout the various drawing figures.

10 Virtual Photon Power Converter
12 AC power in
14 phase control
16 voltage field control
18 voltage/electric-drive transformer—T1
20 voltage/electric-drive transformer primary
22 voltage/electric-drive transformer secondary
24 current-driver current control
26 current/magnetic-drive transformer—T2
28 current/magnetic-drive transformer primary
30 current/magnetic-drive transformer secondary
32 current sensor
34 electric field circuit
36 magnetic field circuit
38 capacitor—C1*a*
40 capacitor—C1*b*
42 mixing capacitor voltage induction plate
44 mixing capacitor voltage/current mixing plate
46 mixing transformer—T3
48 mixing transformer primary
50 mixing transformer secondary
52 fields mixing point
54 virtual photon reference (VPR)
56 converter transformer—T4
58 load
60 AC out
62 virtual photon field
64 insulator
66 conductor
68 insulating caulk
70 capacitor magnetic field circuit
72 capacitor electric field circuit
74 virtual photon force exchange
76 energy harvesting flow chart
78 power amplification flow chart

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of a potential use of the power amplification circuit of the present invention. The present invention provides a circuit designed to harness virtual photons to amplify electrical energy.

Figure 2:
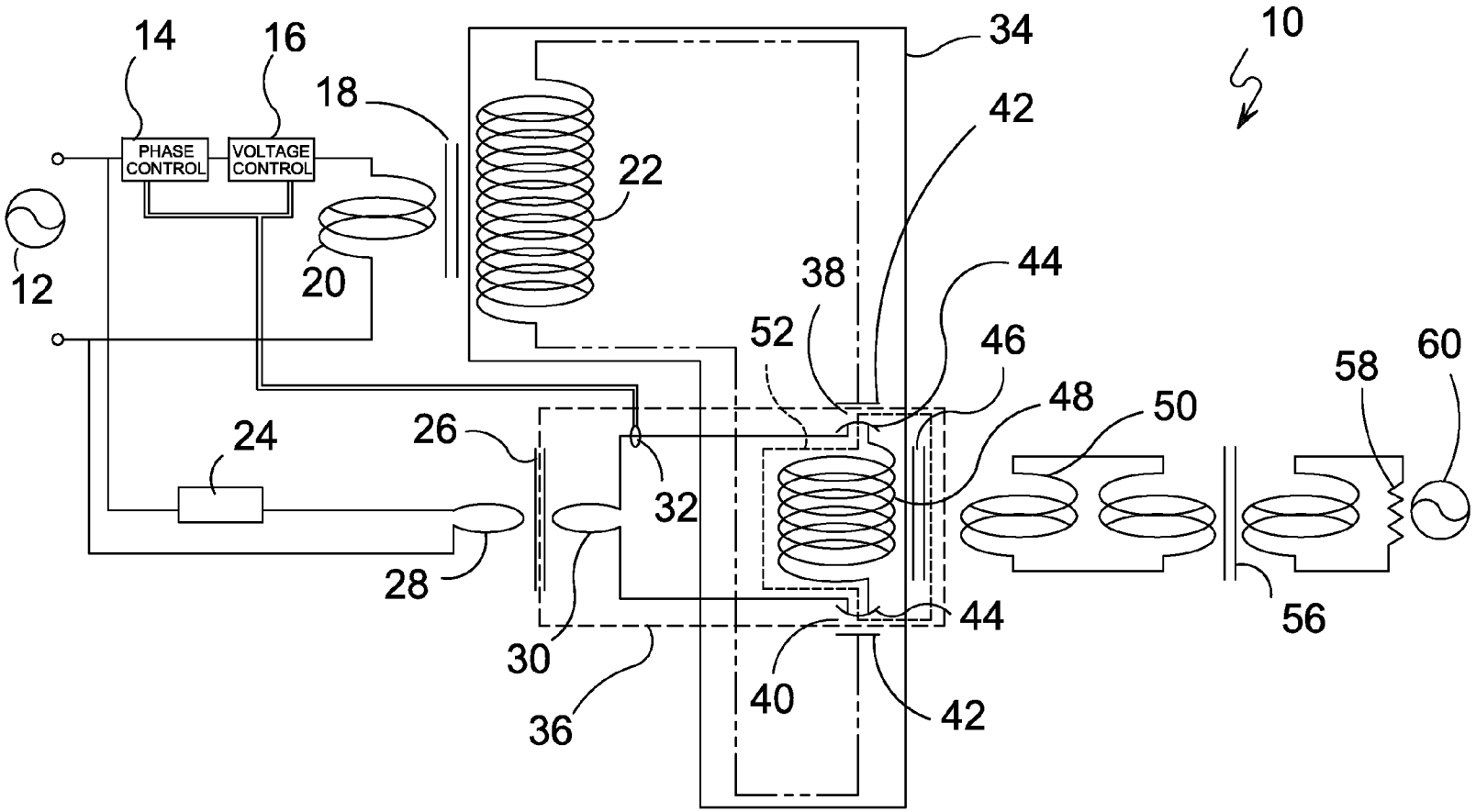
FIG. 2 is a schematic view of the power amplification circuit of the present invention.

Referring to FIG. 2, shown is a schematic view of the power amplification circuit of the present invention 10 having AC power 12. Within the magnetic field circuit 36 a current/magnetic-drive transformer 26 is magnetically producing a current using the plate of a capacitor as a conductor through the mixing transformer 46 primary 48. Within that primary 48 the strength of the expanding and contracting magnetic fields will be in relationship to the current involved. These magnetic fields induce the current within the mixing transformer secondary 50, which goes through the converter transformer 56 and then to the load 58. Within the electric field circuit 34, the exciting voltage in the primary 20 of the voltage/electric-drive transformer 18 is produced and controlled by adjusting the AC voltage phase relative to the incoming current phase of the current/magnetic-drive transformer 26 having current/magnetic-drive transformer primary 28 and current/magnetic-drive transformer secondary 30. Keeping their phase relationship is a current sensor 32 feeding into a phase controller 14. There is also a voltage controller 16 before the voltage/electric-drive transformer 18 primary 20 as well. The high voltage secondary 22 of the voltage/electric-drive transformer 18 is connected to a set of high voltage capacitor-induction plates 42 (for very high voltage applications the voltage/electric-drive transformer would be a Tesla wound coil). The opposing high voltage capacitor-current-mixing plates 44 are connected to the opposing ends of a mixing transformer 46, where the primary 48 is positioned such that the induced high voltage across the capacitor demonstrates as a high voltage across the mixing transformer primary 48 creating field mixing point 52 and virtual photon reference 54. Therefore, the voltage circuit is a transformer attached to two capacitors 38,40 connected in series with an active impedance device 48 in series between the two capacitors.

Figure 3:
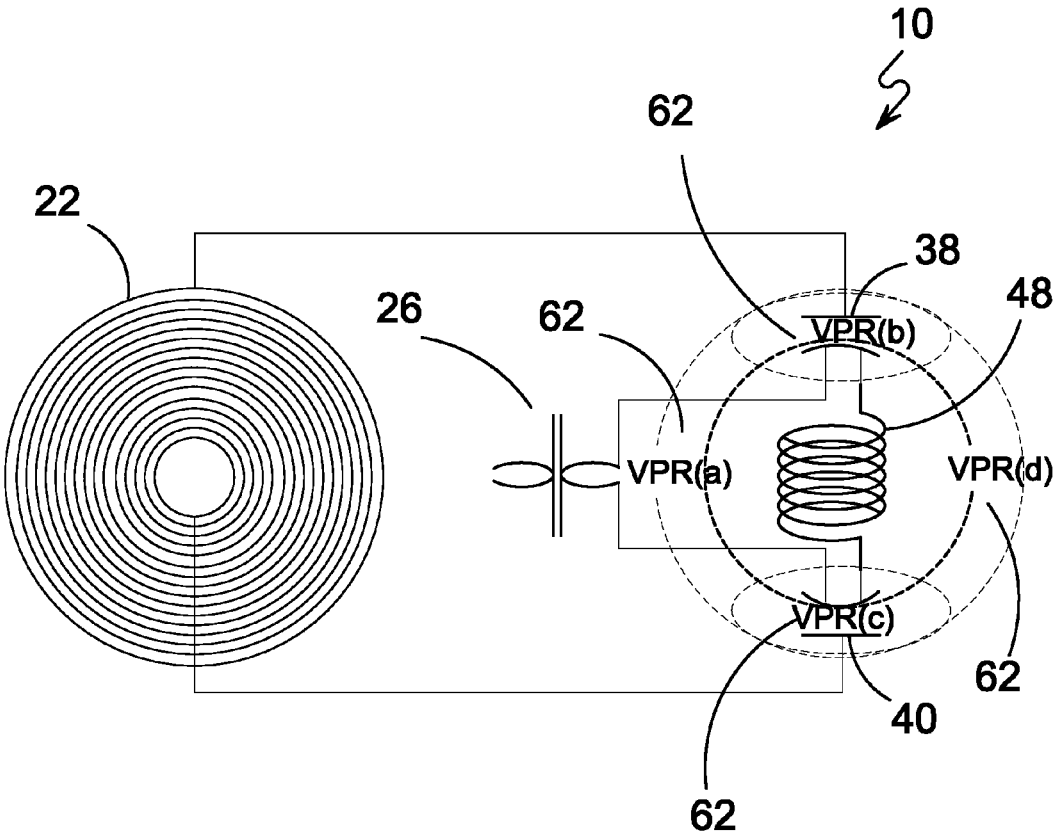
FIG. 3 is an illustrative view of the VPR involvement.

Referring to FIG. 3, shown is an illustration the VPR involvement. As aforementioned, the voltage circuit is a transformer 18 attached to two capacitors 38,40 connected in series with an active impedance device 48 in series between the two capacitors. Typically this type of circuit would draw very little current and be a low VA depending on capacitor size or voltages used. Shown is VPR involvement 62 between the pair of capacitors creating a third and fourth VPR 62 within this assembly.

Figure 4:
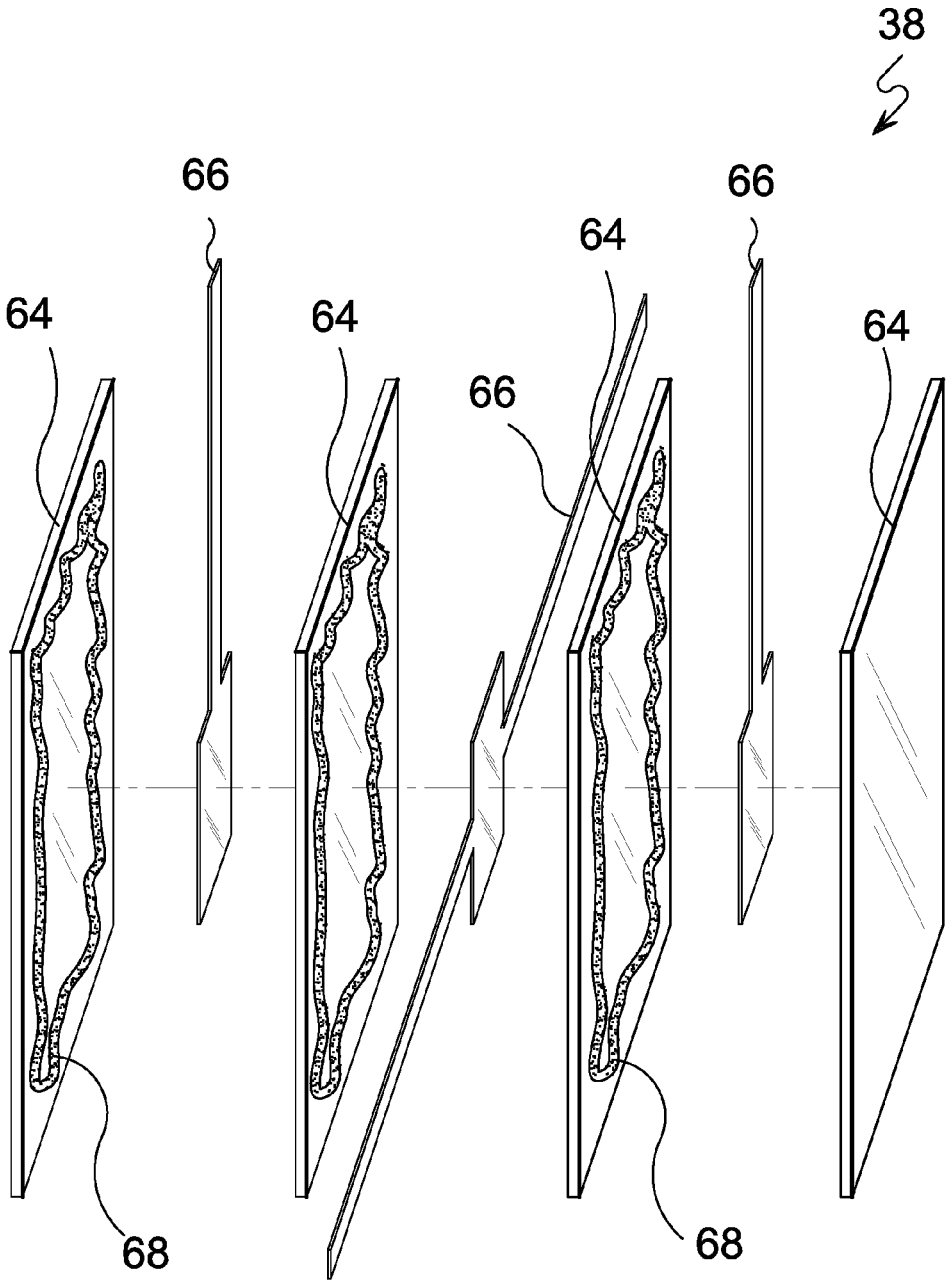
FIG. 4 is an exploded view of an embodiment of the mixing capacitor.
Figure 5:
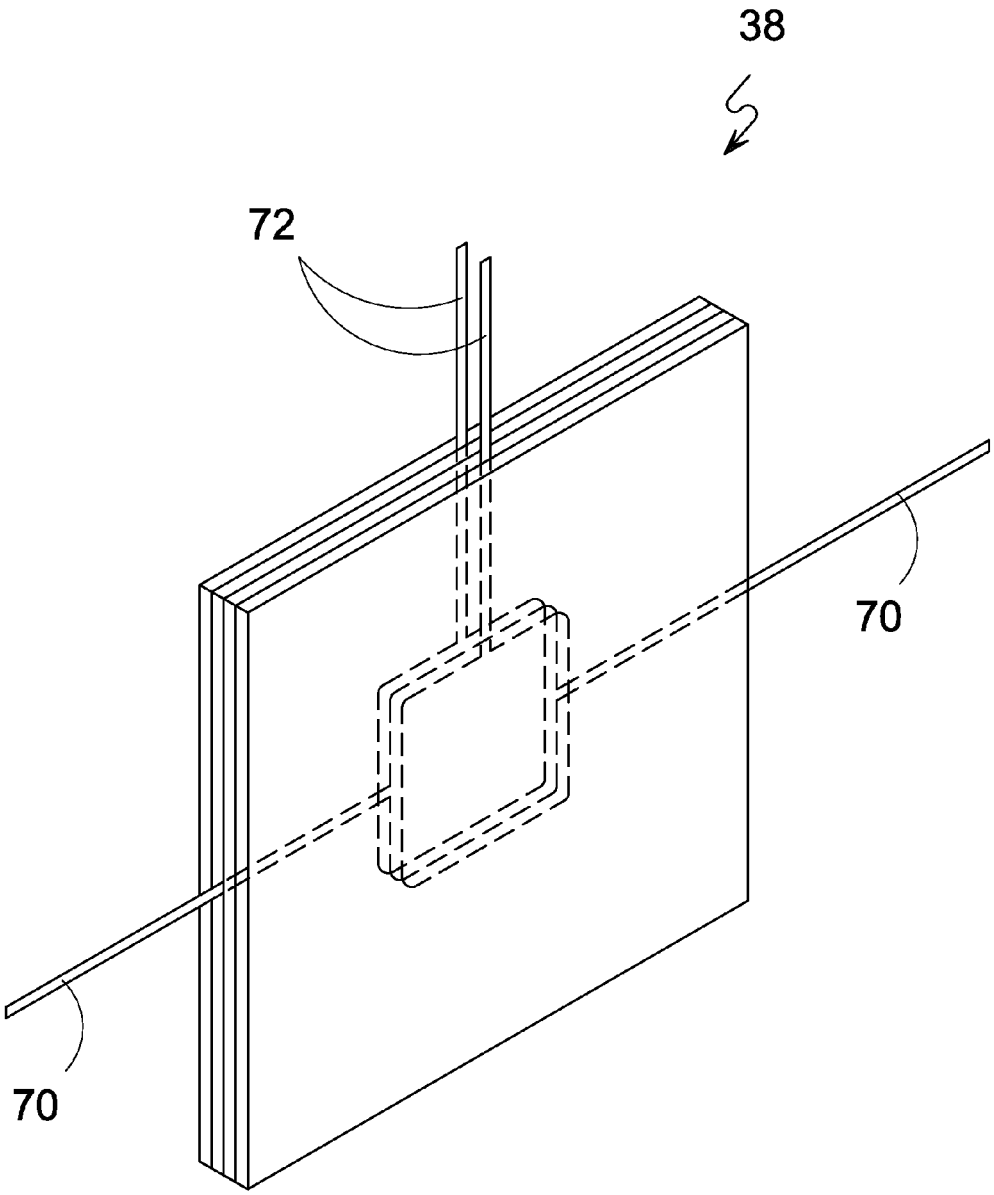
FIG. 5 is an assembled view of an embodiment of the mixing capacitor.

Referring to FIGS. 4 and 5, shown is an assembled view of an embodiment of the mixing capacitor. The mixing capacitor 38 comprises layers of an insulator 64 preferably glass, and conductors 66 preferably metal, having electrically insulating caulk 68 therearound that once assembled creates an electric field circuit and a magnetic field circuit.

Figure 6:
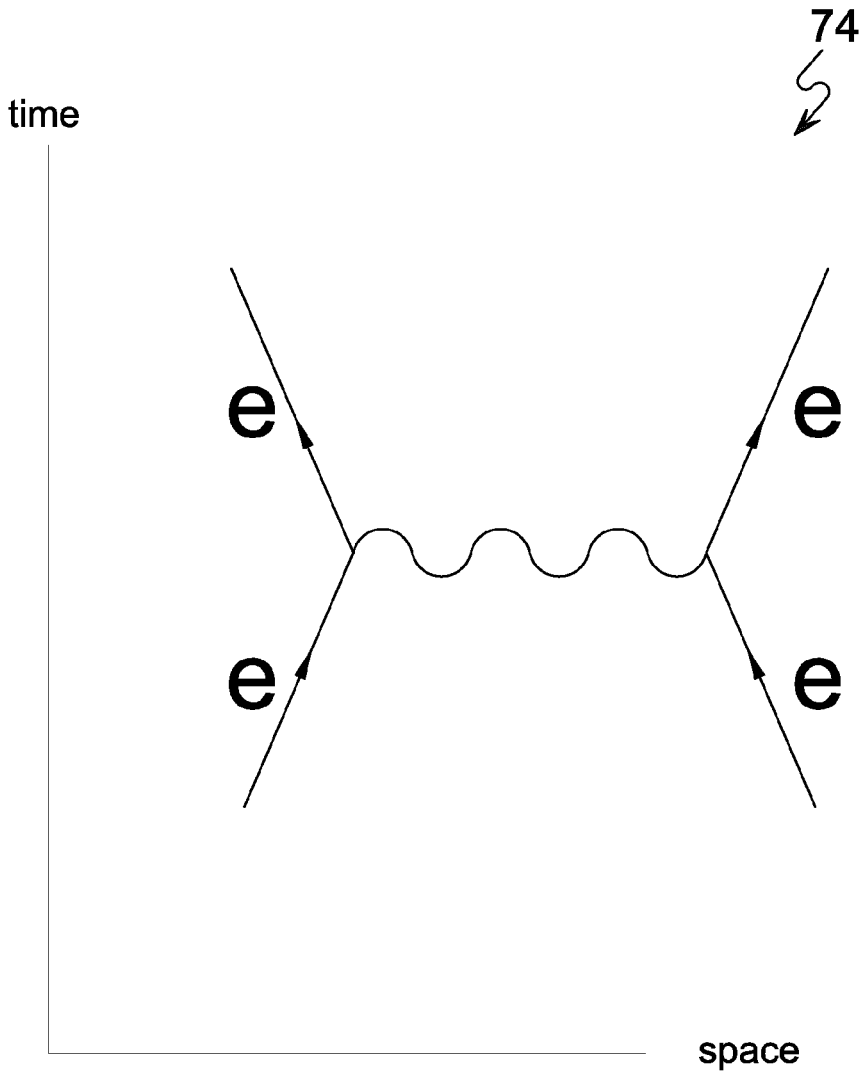
FIG. 6 is an illustrative diagram of force transfer between electrons.
Figure 7:
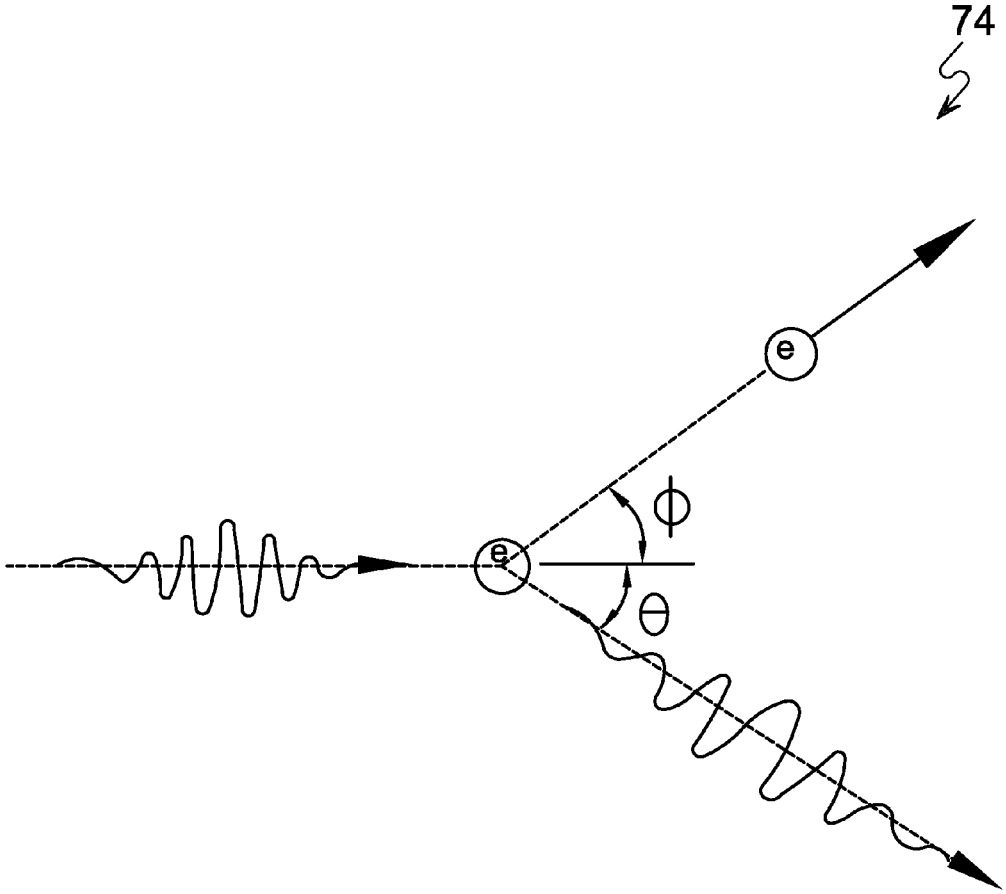
FIG. 7 is an illustrative diagram of force transfer between electrons.
Figure 8:
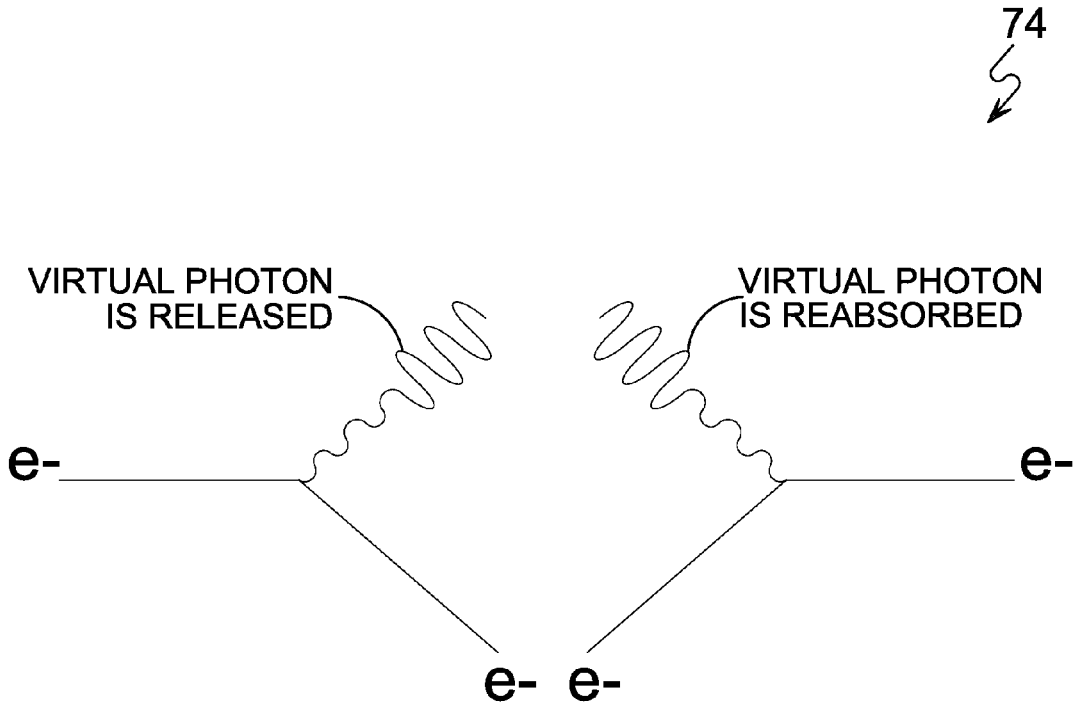
FIG. 8 is an illustrative diagram of force transfer between electrons.

Referring to FIGS. 6 through 8, shown are illustrative diagrams of force transfer 74 between electrons. Quantum electrodynamics, hypothesizes the existence of virtual photons that are hypothetical photons used to explain the physical force occurring between electrons. As shown a virtual photon is generated by a first electron and absorbed by a second electron. The observable particles are represented by solid lines while the wavy lines represent virtual particles, which are harnessed by the present invention to amplify electrical energy.

Figure 9:
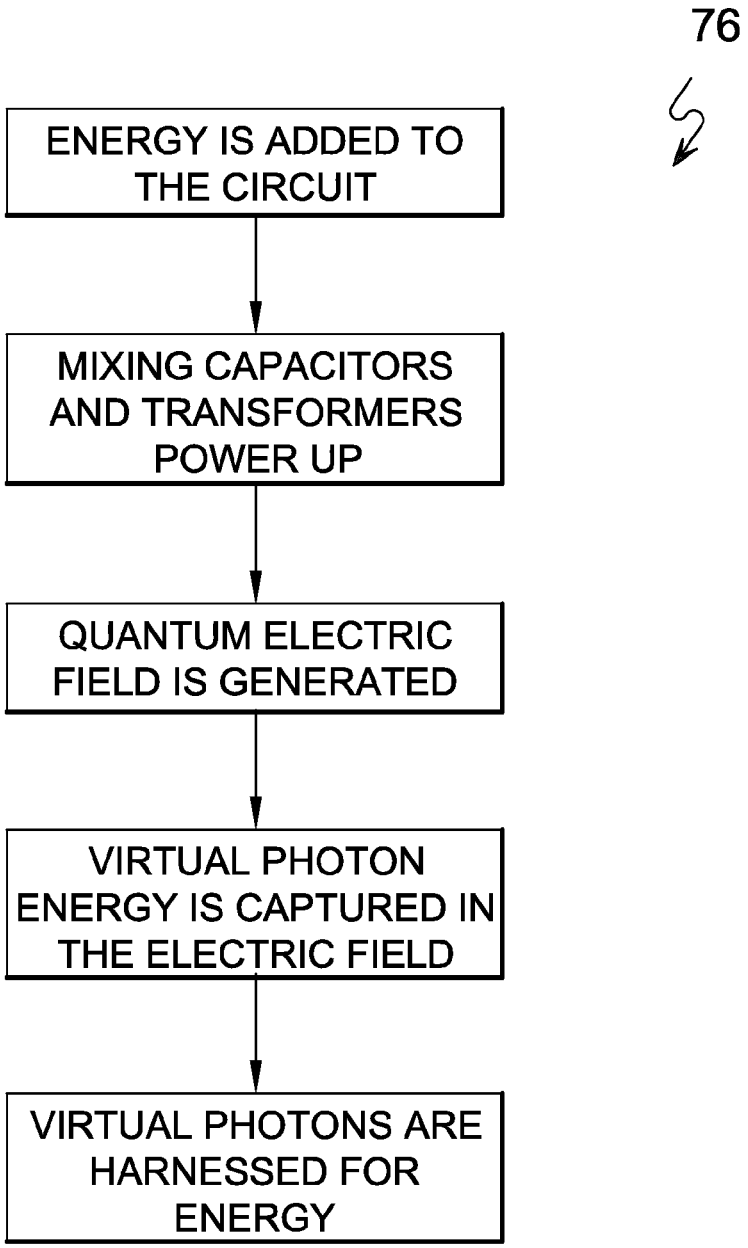
FIG. 9 is a flow chart for harnessing energy by means of the capacitor transformer circuit.

Referring to FIG. 9, shown is a flow chart for harnessing energy by means of the capacitor transformer circuit. The flow chart 76 exemplifies the process for harnessing force or electrical energy from virtual photons existing in a quantum state by adding energy to the circuit that powers up the mixing capacitors and transformers whereupon a quantum field is generated. Virtual photon energy is captured in the electric field wherethen the virtual photons are harnessed for energy.

Figure 10:
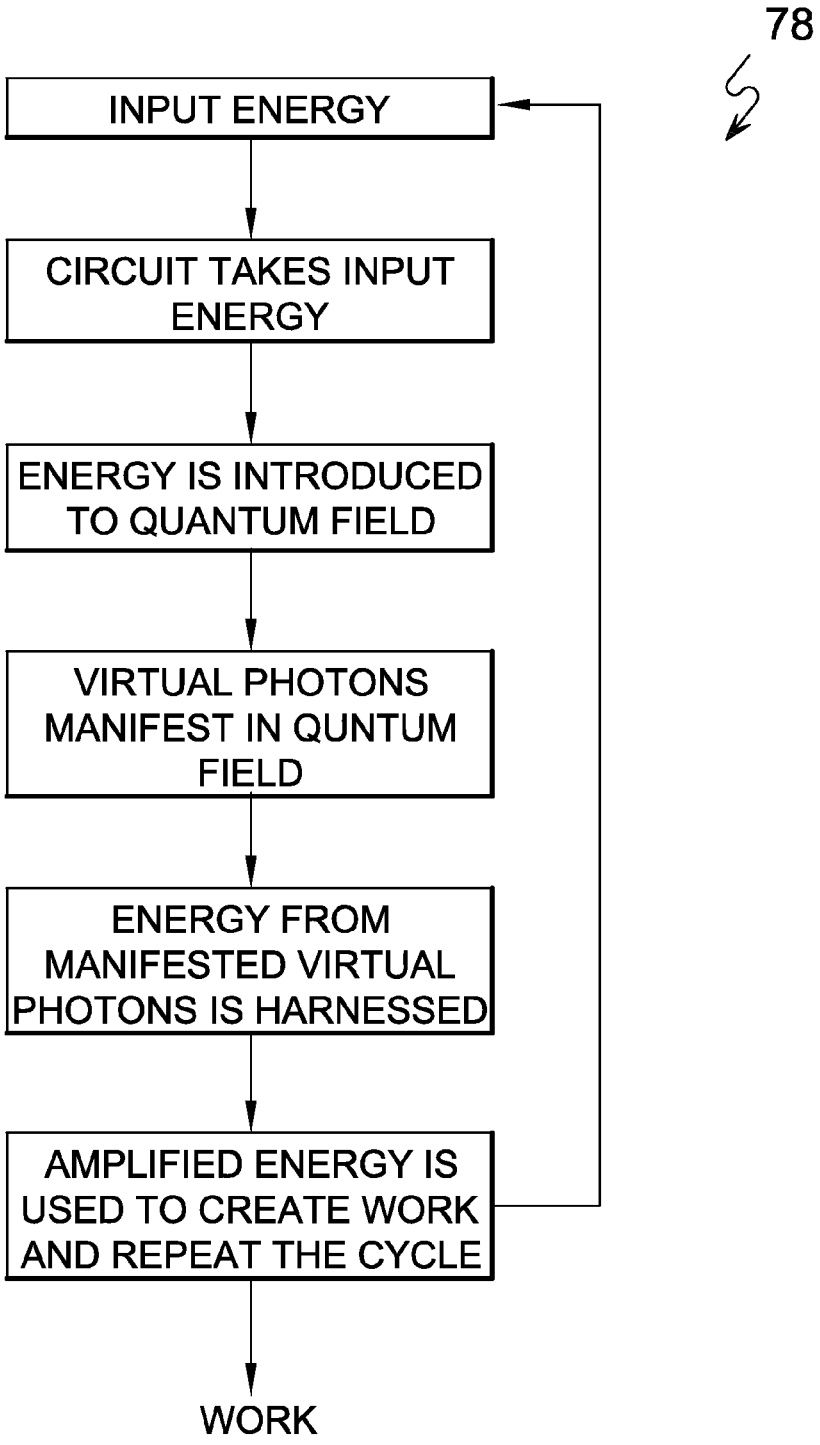
FIG. 10 is a flow chart view of the power amplification process of the present invention.

Referring to FIG. 10, shown is a flow chart view of the power amplification process of the present invention. The flow chart 78 illustrates the present invention converting the infinite power potential of a virtual photon into an actual electromagnetic power drive circuit-electrical energy, thereby amplifying electrical power through the circuit.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A virtual photon power converter circuit comprising:

a) a discrete electric field circuit, said electric field circuit having a discrete power source;

b) a discrete magnetic field circuit, said magnetic field circuit having a discrete power source;

c) circuit for generating a fields mixing point for said discrete electric field circuit and said discrete magnetic field circuit, wherein said circuit generating a fields mixing point comprises a pair of capacitor plates used as conductors between a secondary winding in a first transformer and a primary winding in a second, mixing transformer in the magnetic field circuit forming a capacitive electric field circuit; and d) wherein the primary of said mixing transformer is suspended in the capacitive electric field circuit.

2. The virtual photon power converter circuit of claim 1, wherein said capacitor plates are connected in series with the mixing transformer primary winding therebetween.

3. The virtual photon power converter circuit of claim 2, wherein said capacitor plates provide the magnetic field component for the primary of said mixing transformer.

4. The virtual photon power converter circuit of claim 3, wherein the secondary of said mixing transformer is powered by the mixing of the fields within the primary thereof.

5. The virtual photon power converter circuit of claim 4, wherein each of said capacitor plates is connected in series forming a virtual photon reference.

6. The virtual photon power converter circuit of claim 5, wherein a circuit across said capacitor plates forms a third virtual photon reference.

7. The virtual photon power converter circuit of claim 6, wherein the electric field induced on the capacitor plates and mixing transformer windings creates a fourth virtual photon reference.

8. The virtual photon power converter circuit of claim 7, wherein said fourth virtual photon reference is used to create electrical energy.

9. The virtual photon power converter circuit of claim 1, further comprising a phase control device for keeping the electric field circuit power source across said capacitor plates in a specified phase relationship with the magnetic field circuit power source.

10. The virtual photon power converter circuit of claim 1, further comprising a voltage control device within said electric field circuit.

11. The virtual photon power converter circuit of claim 1, further comprising a current control device within said magnetic field circuit.

* * * * *